US006533434B2

(12) United States Patent
Yuen

(10) Patent No.: US 6,533,434 B2
(45) Date of Patent: Mar. 18, 2003

(54) FLUORESCENT LAMP AND SPOTLIGHT APPARATUS

(76) Inventor: Se Kit Yuen, 6/F., Yau Lee Ctr., 45 Hoi Yuen Rd., Kwun Tong, Kin, Hong Kong (HK)

( * ) Notice: Subject to any disclaimer, the term of this patent is extended or adjusted under 35 U.S.C. 154(b) by 0 days.

(21) Appl. No.: 09/875,804

(22) Filed: Jun. 5, 2001

(65) Prior Publication Data

US 2002/0181230 A1 Dec. 5, 2002

(51) Int. Cl.[7] ..... F21L 11/00

(52) U.S. Cl. ..... 362/184; 362/199; 362/188; 362/427

(58) Field of Search ..... 362/184, 228, 362/183, 188, 197, 208, 199, 287, 427, 236, 217

(56) References Cited

U.S. PATENT DOCUMENTS 4,043,000 A * 8/1977 Bunker ..... 16/384
4,432,043 A * 2/1984 Yuen ..... 200/60
4,977,489 A * 12/1990 Fung ..... 362/184
5,217,297 A * 6/1993 Yuen ..... 362/183
5,816,684 A * 10/1998 Yu ..... 362/191
5,921,658 A * 7/1999 Kovacik et al. ..... 362/197
6,260,985 B1 * 7/2001 Zeller ..... 362/157

* cited by examiner

*Primary Examiner*—Sandra O'Shea
*Assistant Examiner*—Hargobind S. Sawhney
(74) *Attorney, Agent, or Firm*—Raymond V. Chan; David & Raymond Patent Group

(57) ABSTRACT

A fluorescent lamp and spotlight apparatus includes a supporting body having an interior chamber, a spotlight unit cavity, and an exterior mounting slot. A power circuit device is disposed in the interior chamber of the supporting body. A spotlight unit is disposed in the spotlight unit cavity and electrically connected with the power circuit device. A fluorescent unit foldably received in the mounting slot of the supporting body includes a shell, an illuminator protected by the shell, and an electric connector for electrically connecting the illuminator with the power circuit device. Thus, a coupling joint is rotatably attached to the supporting body and pivotally connected with the fluorescent unit, so that the fluorescent lamp and spotlight apparatus enables the user to selectively use as a spotlight torch or a fluorescent lamp while the spotlight unit can be functioned as a stand supporting the fluorescent lamp unit to extend horizontally.

21 Claims, 4 Drawing Sheets

FLUORESCENT LAMP AND SPOTLIGHT APPARATUS

BACKGROUND OF THE PRESENT INVENTION

1. Field of Invention

The present invention relates to an illuminating apparatus, and more particularly to a fluorescent lamp and spotlight apparatus, which enables the user to selectively use as a spotlight torch or a fluorescent lamp while the spotlight unit can be functioned as a stand supporting the fluorescent lamp unit to extend horizontally.

2. Description of Related Arts

Battery operated lanterns are known as having a facility for selectively providing a spotlight and a fluorescent light. Such conventional lantern comprises a main body having a battery storage, a spotlight unit installed at one side of the main body and a fluorescent lamp unit installed at another side of the main body, such that the user is able to select the spotlight and the fluorescent light by switching a switch button. However, the conventional lantern has several drawbacks.

Due to the electric circuit design, a circuit board is disposed in the main body for electrically connecting with both the fluorescent unit and spotlight unit in such a manner that the switch button is arranged to control both the fluorescent unit and the spotlight unit. In order to ensure the connection between circuit board and the fluorescent unit, the fluorescent unit is usually affixed to the main body. However, it is a great hassle that the user has to hold the relative huge sized lantern by hand or to support it by hanging up for illumination.

Moreover, although lantern is designed to be easier to sit on a surface, it is too troublesome and relatively heavy for hand carrying. On the other hand, a torch is very handy for handholding but it fails to steadily rest on a supporting surface such as a desk top for illumination.

SUMMARY OF THE PRESENT INVENTION

A main object of the present invention is to provide a fluorescent lamp and spotlight apparatus, which comprises a fluorescent unit and a spotlight unit for providing both fluorescent light and spotlight respectively.

Another object of the present invention is to provide a fluorescent lamp and spotlight apparatus, which enables the user to selectively use as a hand-held spotlight or a fluorescent lamp while the spotlight unit can be functioned as a stand supporting the fluorescent lamp unit to extend horizontally Another object of the present invention is to provide a fluorescent lamp and spotlight apparatus, which comprises a contact switch for the fluorescent unit, so as to prevent the electrical disconnection of the fluorescent unit when rotating over a period of continued use.

Another object of the present invention is to provide a fluorescent lamp and spotlight apparatus, wherein the fluorescent unit is adjustably that the illuminating angle of the fluorescent unit can be varied to fit the need of the user.

Another object of the present invention is to provide a fluorescent lamp and spotlight apparatus, wherein no expensive or complicate mechanical structure is required to employ in the fluorescent lamp and spotlight apparatus, so as to minimize the manufacturing cost of the present invention.

Another object of the present invention is to provide a fluorescent lamp and spotlight apparatus, wherein the fluorescent unit is adapted for being supported by the casing, so as to function as a desk lamp supported on the desk.

Another object of the present invention is to provide a fluorescent lamp and spotlight apparatus, which is handy and has relative small size for easy carriage and storage.

Accordingly, in order to accomplish the above objects, the present invention provides a fluorescent lamp and spotlight apparatus, which comprises:

- a supporting body having an interior chamber, a spotlight unit cavity provided at one end thereof, and an exterior mounting slot provided on a longitudinal side thereof;
- a power circuit device received in the interior chamber of the supporting body;
- a spotlight unit, which is fittedly disposed in the spotlight unit cavity of the supporting body and electrically connected with the power circuit device, comprising a light housing having a bulb socket adapted to replaceably mount a light bulb thereon;
- a fluorescent unit, fittedly received in the mounting slot of the supporting body, comprising a shell, an illuminator protected by the shell, and an electric connector for electrically connecting the illuminator with the power circuit device; and
- a coupling joint rotatably attached to the supporting body and pivotally connected with the fluorescent unit, so as to rotatably adjust a folding angle between the fluorescent unit and the supporting body.

DETAILED DESCRIPTION OF THE PREFERRED EMBODIMENT

Figure 1:
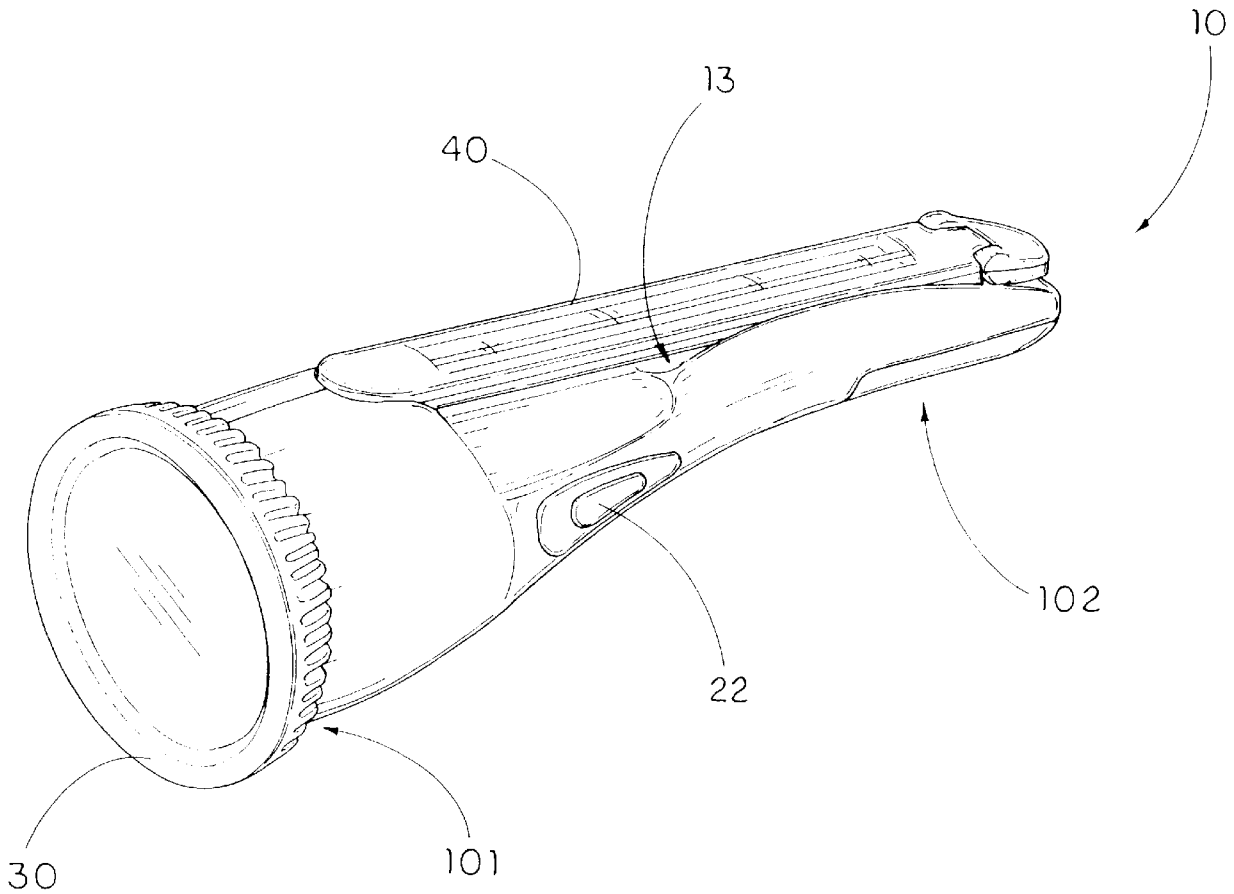
FIG. 1 is a perspective view of a fluorescent lamp and spotlight apparatus according to a preferred embodiment of the present invention.
Figure 2:
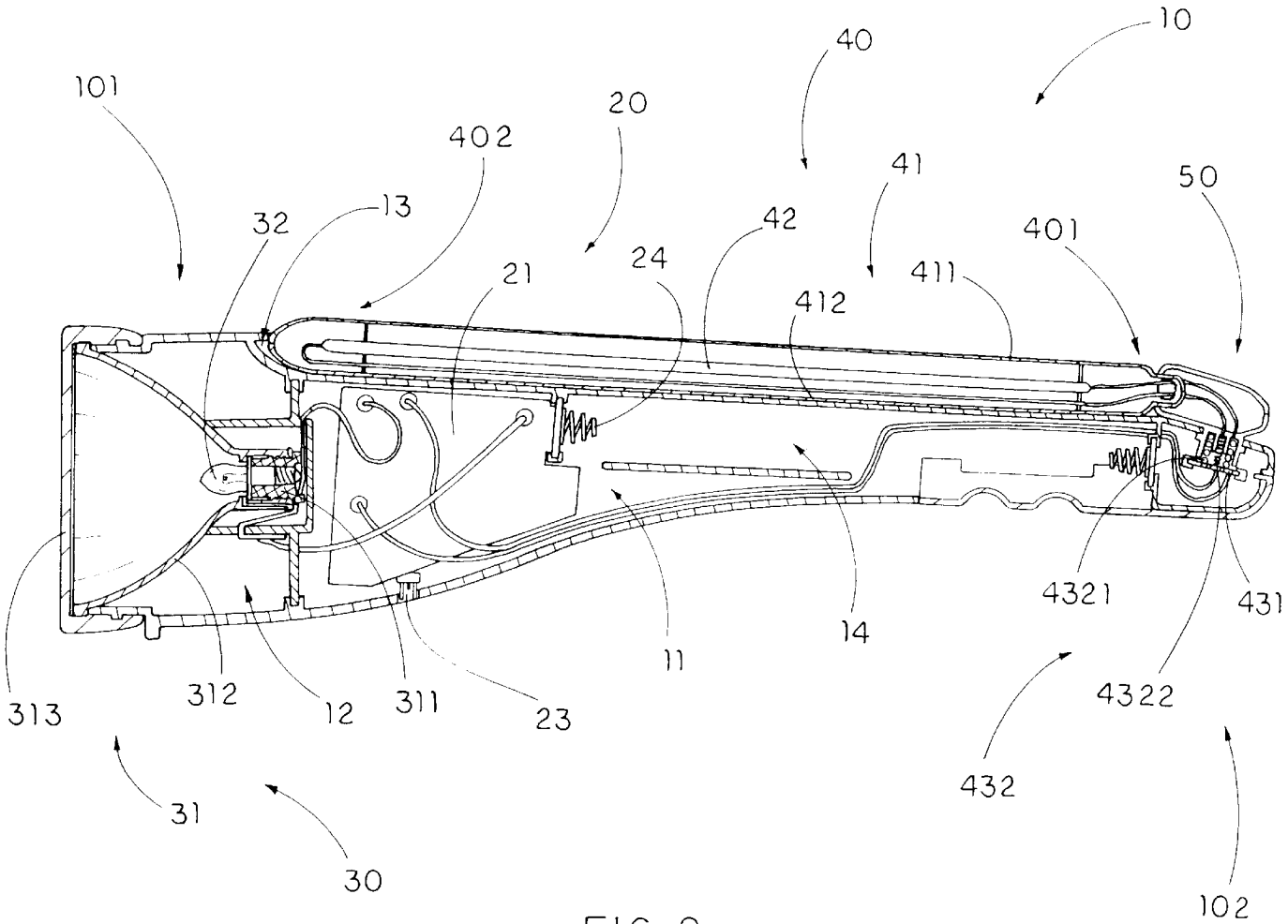
FIG. 2 is sectional view of the fluorescent lamp and spotlight apparatus according to the above preferred embodiment of the present invention.

Referring to FIGS. 1 and 2 of the drawings, a fluorescent lamp and spotlight apparatus according to a preferred embodiment of the present invention is illustrated, which comprises a supporting body 10, a power circuit device 20, a spotlight unit 30, and a fluorescent unit 40.

The supporting body 10, which is an elongated case body, has an interior chamber 11 provided therein, a spotlight unit cavity 12 provided thereon, and an exterior mounting slot 13 provided on a longitudinal side thereof. Moreover, a battery compartment 14 is formed in the interior chamber 11 for receiving at least a replaceable battery therein to electrically connect with the power circuit device 20.

The power circuit device 20 comprises an IC board 21 securely supported in the interior chamber 11 of the supporting body 10, a control switch 22 electrically connected to the IC board 21 for selectively controlling the spotlight unit 30 and the fluorescent unit 40 in an on and off manner respectively, an AC current connector 23 which is provided on the supporting body 10 and electrically connected with the IC board 21, and a battery connector 24 which is disposed in the interior chamber 11 and electrically connected with the IC board 21. In other words, the fluorescent lamp and spotlight apparatus is adapted for using both AC current supplied by an electric cord electrically connecting the AC current connector 23 with a normal power outlet and DC current supplied by the battery disposed in the battery compartment 14.

The spotlight unit 30 comprises a light housing 31 having a bulb socket 311 and a light bulb 32 replaceably mounted on the bulb socket 311 and protected by the light housing 31, wherein the spotlight unit 30 is fittedly disposed in the spotlight unit cavity 12 of the supporting body 10 and electrically connected with the power circuit device 20.

The fluorescent unit 40 is fittedly received in the mounting slot 13 of the supporting body 10 and comprises a shell, an illuminator 42 protected by the shell 41, and an electric connector 43 for electrically connecting the illuminator 42 with the power supply device 20.

The fluorescent lamp and spotlight apparatus further comprises a coupling joint 50 rotatably attached to the supporting body 10 and pivotally connected with a pivot end 401 of the fluorescent unit 40, so as to rotatably adjust a folding position of the fluorescent unit 40 with respect to the supporting body 10.

According to the preferred embodiment, the supporting body 10 further has an enlarged first end portion 101 to form the spotlight unit cavity 12 thereto and an elongated second end portion 102 wherein the mounting slot 13 is an elongated slot extended from the second end portion 102 of the supporting body 10 towards to the first end portion 101 thereof.

The spotlight unit 30 is adapted for projecting a beam of light from the first end portion 101 of the supporting body 10 in a latitudinal direction, wherein the light housing 31 of the spotlight unit 30 comprises a cone shaped reflecting bowl 312, having an inner concave light projecting surface, fittedly disposed in the spotlight unit cavity 12 of the supporting body 10 wherein the bulb socket 311 is coaxially mounted on the reflecting bowl 312 for replaceably mounting the light bulb 32 therein, and a protecting cap 313 having a transparent front surface detachably mounted to the first end portion 101 of the supporting body 10 for enclosing the spotlight unit cavity 12, so as to protect the light bulb 32 therein.

The fluorescent unit 40 is movably attached to the supporting body 10 wherein the shell 41 of the fluorescent unit 40 comprises an elongated first plane 411 having a transparent surface and an elongated second panel 412 having an inner light reflecting surface securely mounted on the first panel 411 wherein the illuminator 42 is securely received between the first and second panels 411, 412. Accordingly, the illuminator 42 is a fluorescent tube adapted for emitting fluorescent light to an exterior of the shell 41 through the transparent surface of the first plane 411.

The electric connector 43 according to the preferred embodiment is a contact switch comprising a conductive panel 431 attached to the second end portion 102 of the supporting body 10 and electrically connect to the power circuit device 20, and a conductive unit 432 having a resilient properties extended from the coupling joint 50 and electrically connected with the illuminator 42 for applying an urging pressure against the conductive panel 431, so as to electrically connect the illuminator 42 with the power circuit device 20.

Accordingly, the conductive unit 432 comprises two resilient terminals 4321, 4322, which are two compression springs coaxially extended from the coupling joint 50, biased against the conductive panel 431 respectively in a contact manner for electrically connecting the illuminator 42 with the power circuit device 20.

Figure 3:
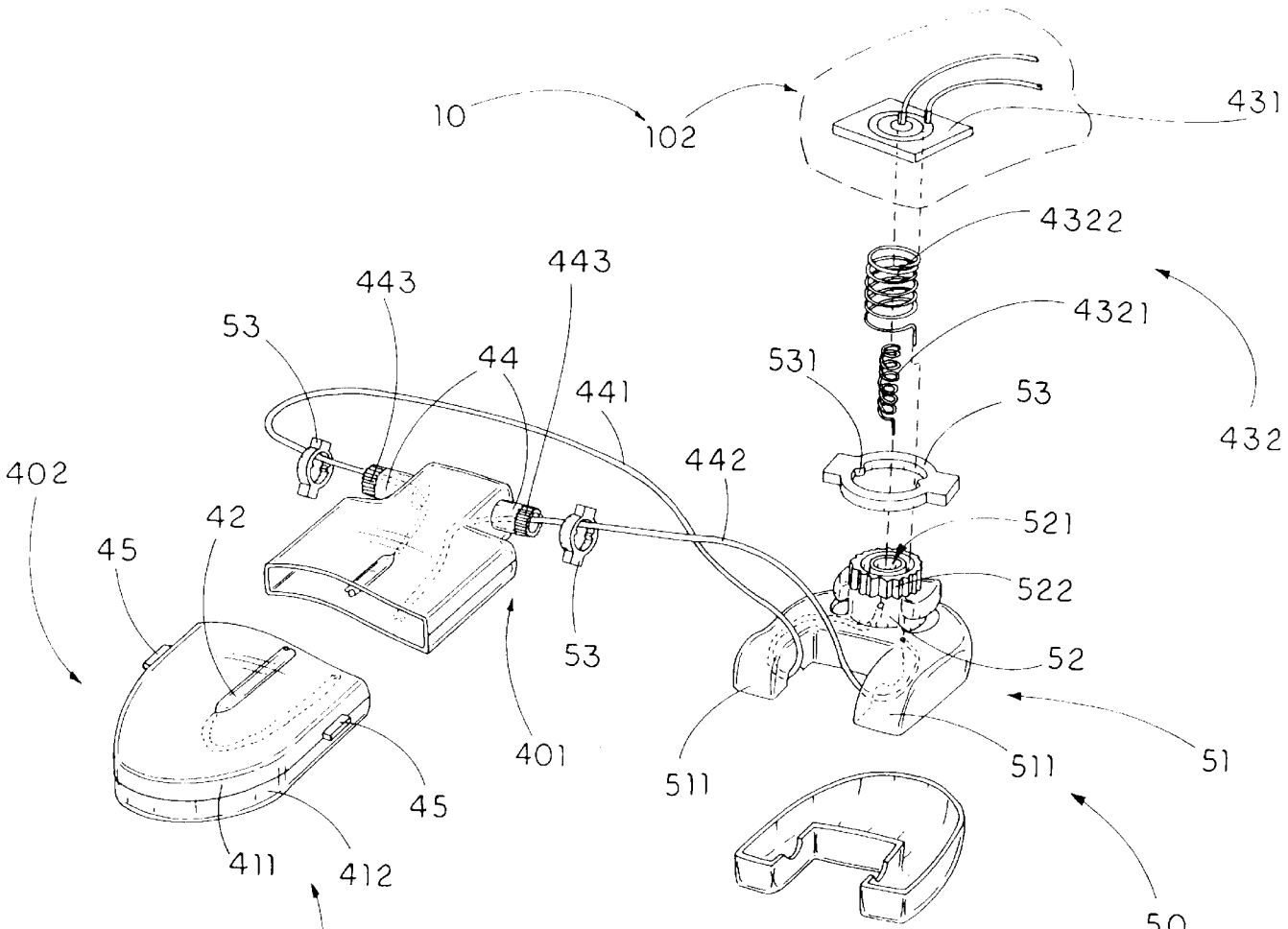
FIG. 3 is an exploded perspective view of a coupling joint of the fluorescent lamp and spotlight apparatus according to the above preferred embodiment of the present invention.

As shown in FIG. 3, the coupling joint 50 comprises a U-shaped joint body 51 having two parallel pivot arms 511 for pivotally connecting the pivot end 401 of the shell 41 of the fluorescent unit 40 and a joint axle 52 integrally protruded from the joint body 51 to rotatably mount on the second end portion 102 of the supporting body 10. Moreover, the joint axle 52 comprises two coaxial terminal housings 521 for the two ends of the two resilient terminals 4321, 4322 coaxially mounted therein respectively.

Accordingly, two pivot axles 44 are outwardly protruded from two sides of the pivot end 401 of the fluorescent unit 40 respectively wherein the two pivot axles 44 are rotatably penetrated through two inner walls of the two pivot arms 511 of the joint body 51 so as to pivotally connect the pivot end 401 of the fluorescent unit 40 to the coupling joint 50.

In order to electrically connect the conductive unit 432 with the illuminator 42, the fluorescent unit 40 further comprises two connecting wires 441, 442 extended from the two resilient terminals 4321, 4322 to two ends of the illuminator 42 through the two pivot arms 511 respectively, so that the fluorescent unit 40 is adapted for pivotally rotating with respect to the supporting body 10 without interfering the electrical connection between the illuminator 42 and the power circuit device 20. In other words, each of the connecting wires 441, 442 is extended through the respective pivot axle 44 to the respective end of the illuminator 42 to prevent the connecting wire 411, 442 from being broken during the pivot movement of the fluorescent unit 40.

The coupling joint 50 further comprises a ring shaped holding guider 53 having an elastic ability securely disposed in the second end portion 102 of the supporting body 10 wherein the joint axle 52 is rotatably inserted into the holding guider 53. At least an engaging tooth 531 is protruded from an inner circumferential surface of the holding guider 53 for selectively engaging with a plurality of gear teeth 522 evenly formed on an outer circumferential surface of the joint axle 52, so as to hold the rotating position of the fluorescent unit 40 with respect to the supporting body 10.

As shown in FIG. 3, there are two more holding guiders 53 having smaller sizes securely received in the two pivot arms 511 of the fluorescent unit 40 wherein the engaging tooth 531 of each holding guider 53 is selectively engaging a plurality of holding tooth 443 evenly protruded from an outer circumferential surface of the respective pivot axle 44 so as to hold the pivotal position of the fluorescent unit 40 with respect to the supporting body 10.

Besides, at least one protrusion 45 is protruded from a free end 402 of the fluorescent unit 40 and adapted for engaging with a sidewall of the mounting slot 13 at the first end portion 101 of the supporting body 10, so as to hold the fluorescent unit 40 on the mounting slot 13 of the supporting body 10 in position.

Figure 4:
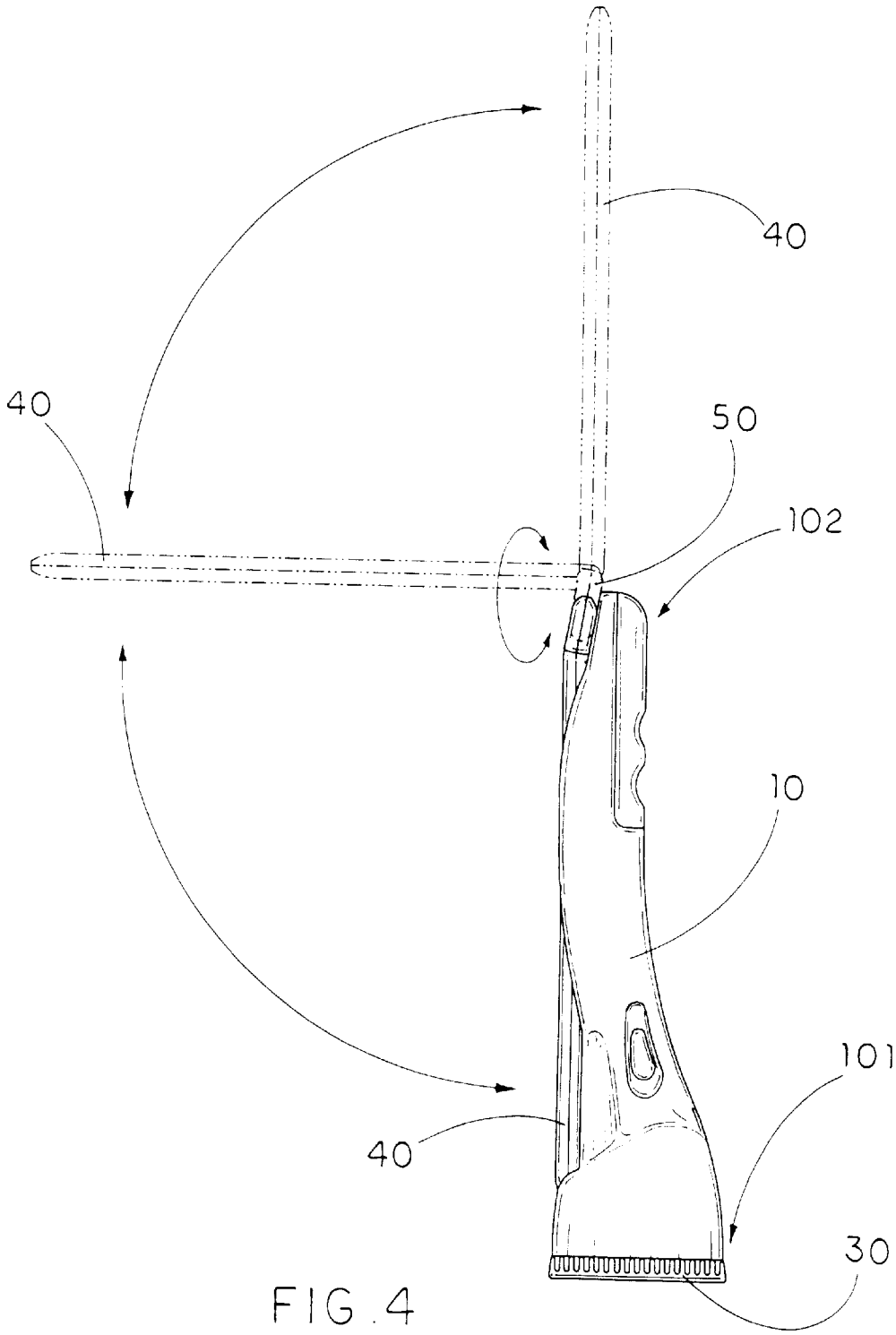
FIG. 4 is a side view of the fluorescent lamp and spotlight apparatus according to the above preferred embodiment of the present invention, illustrating the folding position of the fluorescent unit.

FIG. 4 illustrates the various folding positions of the fluorescent unit 40 with respect to the supporting body 10. In a normal folded position, as shown in FIG. 1, the fluorescent unit 40 is folded to receive in the mounting slot 13 of the supporting body 10 for easily storage and carriage. The fluorescent unit 40 is capable of folding into a 90-degree (horizontal) position with respect to the supporting body 10 to form as a desk lamp wherein the first end portion 101 of the supporting body 10 can be supported on a desk. Thus, the slim size of the fluorescent unit 40 can be inserted into a narrow gap such as a gap between a desk and a wall for searching purpose. It is worth to mention again that the fluorescent unit 40 is electrically connected to the power circuit device 20 by the contact switch, so that the electrical connection will not be damaged by the rotating movement of the fluorescent unit 40.

In other words, as shown in FIG. 1, when the fluorescent unit 40 is parallelly received in the mounting slot 13 of the supporting body 10, the fluorescent lamp and spotlight apparatus of the present invention is prefect to function as a torch such that the user can directly hand grip on the supporting body 10. As shown in FIG. 4, when the fluorescent unit 40 is unfolded to a horizontal position, the fluorescent lamp and spotlight apparatus can alternatively be functioned as a desk lamp, wherein the supporting body 10 can be rest on a desk top surface by sitting the spotlight unit 30 upside down. Due to the slim size of the supporting body and the enlarged first end portion 101 of the supporting body 10, it will not occupy much space on the desk surface. For example, in fact, it is prefect for sitting the fluorescent lamp and spotlight apparatus adjacent to the keyboard of the computer for extra illumination when typing. The user may selectively use the AC or DC power supply, depending on various situations. When required, anytime, the user may simply take up the fluorescent lamp and spotlight apparatus from the desk for other torch lighting usages at home or in the user's office.

Moreover, by further up folding the fluorescent unit 40 to a vertical position, the fluorescent lamp and spotlight apparatus of the present invention becomes a specific and unique torch to provide an elongated illuminating ability, i.e. the extended fluorescent unit 40 specially adapted to be inserted into a narrow gap such as a gap between a desk and a wall for searching purpose. The fluorescent lamp and spotlight apparatus of the present invention is a good carrying item for travelers too because it not only provides additional or emergency illumination purposes while traveling elsewhere but also is practical to be used with the notebook so as to ensure the traveler has enough lighting for the notebook's keyboard.

What is claimed is:

1. A fluorescent lamp and spotlight apparatus, comprising:

a supporting body having an interior chamber, a spotlight unit cavity provided at one end thereof, and an exterior mounting slot provided on a longitudinal side thereof, wherein said supporting body has an enlarged first end portion and an elongated second end portion, wherein said spotlight unit cavity is formed at said first end portion of said supporting body and said mounting slot is extended from said second end portion towards said first end portion of said supporting body;

a power circuit device received in said interior chamber of said supporting body;

a spotlight unit, which is disposed in said spotlight unit cavity of said supporting body and electrically connected with said power circuit device, comprising a light housing having a bulb socket adapted to replaceably mount a light bulb thereon,;

a fluorescent unit comprising a shell received in said mounting slot of said supporting body, an illuminator protected by said shell, and an electric connector for electrically connecting said illuminator with said power circuit device; and a coupling joint rotatably attached to said supporting body and pivotally connected with said fluorescent unit, so as to rotatably adjust a folding position of said fluorescent unit with respect to said supporting body, wherein said electric connector is a contact switch comprising a conductive panel attached to said second end portion of said supporting body and electrically connected to said power circuit device, and a conductive unit having resilient properties extended from said coupling joint and electrically connected with said illuminator for applying an urging pressure against said conductive panel, so as to electrically connect said illuminator with said power circuit device.

2. A fluorescent lamp and spotlight apparatus, as recited in claim 1, wherein said conductive unit comprises two resilient terminals, which are two compression springs coaxially extended from said coupling joint, biased against said conductive panel respectively in a contact manner for electrically connecting said illuminator with said power circuit device.

3. A fluorescent lamp and spotlight apparatus, as recited in claim 2, wherein said coupling joint comprises a U-shaped joint body having two parallel pivot arms for pivotally connecting a pivot end of said fluorescent unit and a joint axle integrally protruded from said joint body to rotatably mount on said second end portion of said supporting body.

4. A fluorescent lamp and spotlight apparatus, as recited in claim 3, wherein said fluorescent unit further comprises two pivot axles outwardly protruded from two sides of said pivot end of said fluorescent unit respectively wherein said two pivot axles are rotatably penetrated through two inner walls of said two pivot arms of said joint body so as to pivotally connect said pivot end of said fluorescent unit to said coupling joint.

5. A fluorescent lamp and spotlight apparatus, as recited in claim 4, wherein said fluorescent unit further comprises two connecting wires extended from said two resilient terminals to two ends of said illuminator through said two pivot axles respectively, so as to prevent said connecting wire from being broken during a pivot movement of said fluorescent unit.

6. A fluorescent lamp and spotlight apparatus, as recited in claim 5, wherein said coupling joint further comprises a ring shaped holding guider having an elastic ability securely disposed in said second end portion of said supporting body wherein said joint axle is rotatably inserted into said holding guider, at least an engaging tooth being protruded from an inner circumferential surface of said holding guider to selectively engage with a plurality of gear teeth evenly formed on an outer circumferential surface of said joint axle, so as to hold a rotating position of said fluorescent unit with respect to said supporting body.

7. A fluorescent lamp and spotlight apparatus, as recited in claim 6, wherein said joint axle comprises two coaxial terminal housings for two ends of said two resilient terminals coaxially mounted therein respectively.

8. A fluorescent lamp and spotlight apparatus, as recited in claim 6, wherein said coupling joint further comprises two more said holding guiders securely received in said two pivot arms of said fluorescent unit wherein said engaging tooth of each said holding guider in said pivot arm is selectively engaging a plurality of holding tooth evenly protruded from an outer circumferential surface of said respective pivot axle so as to hold a pivotal position of said fluorescent unit with respect to said supporting body.

9. A fluorescent lamp and spotlight apparatus, as recited in claim 8, wherein said power circuit device comprises an IC board securely disposed in said interior chamber of said supporting body, a control switch on said supporting body for selectively controlling said spotlight unit and said fluorescent unit in an on and off manner respectively, an AC current connector provided on said supporting body and electrically connected with said IC board, and a battery connector disposed in said interior chamber and electrically connected with said IC board.

10. A fluorescent lamp and spotlight apparatus, as recited in claim 6, wherein said power circuit device comprises an IC board securely disposed in said interior chamber of said supporting body, a control switch on said supporting body for selectively controlling said spotlight unit and said fluorescent unit in an on and off manner respectively, an AC current connector provided on said supporting body and electrically connected with said IC board, and a battery connector disposed in said interior chamber and electrically connected with said IC board.

11. A fluorescent lamp and spotlight apparatus, as recited in claim 5, wherein said joint axle comprises two coaxial terminal housings for two ends of said two resilient terminals coaxially mounted therein respectively.

12. A fluorescent lamp and spotlight apparatus, as recited in claim 4, wherein said coupling joint further comprises a ring shaped holding guider having an elastic ability securely disposed in said second end portion of said supporting body wherein said joint axle is rotatably inserted into said holding guider, at least an engaging tooth being protruded from an inner circumferential surface of said holding guider to selectively engage with a plurality of gear teeth evenly formed on an outer circumferential surface of said joint axle, so as to hold a rotating position of said fluorescent unit with respect to said supporting body.

13. A fluorescent lamp and spotlight apparatus, as recited in claim 12, wherein said coupling joint further comprises two more said holding guiders securely received in said two pivot arms of said fluorescent unit wherein said engaging tooth of each said holding guider in said pivot arm is selectively engaging a plurality of holding tooth evenly protruded from an outer circumferential surface of said respective pivot axle so as to hold a pivotal position of said fluorescent unit with respect to said supporting body.

14. A fluorescent lamp and spotlight apparatus, as recited in claim 4, wherein said joint axle comprises two coaxial terminal housings for two ends of said two resilient terminals coaxially mounted therein respectively.

15. A fluorescent lamp and spotlight apparatus, as recited in claim 4, wherein said power circuit device comprises an IC board securely disposed in said interior chamber of said supporting body, a control switch on said supporting body for selectively controlling said spotlight unit and said fluorescent unit in an on and off manner respectively, an AC current connector provided on said supporting body and electrically connected with said IC board, and a battery connector disposed in said interior chamber and electrically connected with said IC board.

16. A fluorescent lamp and spotlight apparatus, comprising:

a supporting body having an interior chamber, a spotlight unit cavity provided at one end thereof, and an exterior mounting slot provided on a longitudinal side thereof;

a power circuit device received in said interior chamber of said supporting body;

a spotlight unit, which is disposed in said spotlight unit cavity of said supporting body and electrically connected with said power circuit device, comprising a light housing having a bulb socket adapted to replaceably mount a light bulb thereon;

a fluorescent unit comprising a shell received in said mounting slot of said supporting body, an illuminator protected by said shell, an electric connector for electrically connecting said illuminator with said power circuit device, two pivot axles outwardly protruded from two sides of said pivot end of said fluorescent unit respectively, and two connecting wires extended from said two resilient terminals to two ends of said illuminator through said two pivot axles respectively so as to prevent said connecting wire from being broken during a pivot movement of said fluorescent unit; and a coupling joint rotatably attached to said supporting body and pivotally connected with said fluorescent unit, so as to rotatably adjust a folding position of said fluorescent unit with respect to said supporting body, wherein said coupling joint comprises a U-shaped joint body having two parallel pivot arms for pivotally connecting a pivot end of said fluorescent unit and a joint axle integrally protruded from said joint body to rotatably mount on anther end of said supporting body, wherein said two pivot axles said fluorescent unit are rotatably penetrated through two inner walls of said two pivot arms of said joint body so as to pivotally connect said pivot end of said fluorescent unit to said coupling joint.

17. A fluorescent lamp and spotlight apparatus, comprising:

a supporting body having an interior chamber, a spotlight unit cavity provided at one end thereof, and an exterior mounting slot provided on a longitudinal side thereof, wherein said supporting body has an enlarged first end portion and an elongated second end portion, wherein said spotlight unit cavity is formed at said first end portion of said supporting body and said mounting slot is extended from said second portion towards said first end portion of said supporting body;

a power circuit device received in said interior chamber of said supporting body;

a spotlight unit, which is disposed in said spotlight unit cavity of said supporting body and electrically connected with said power circuit device, comprising a light housing having a bulb socket adapted to replaceably mount a light bulb thereon;

a fluorescent unit comprising a shell received in said mounting slot of said supporting body, an illuminator protected by said shell, an electric connector for electrically connecting said illuminator with said power circuit device, two pivot axles outwardly protruded from two sides of said pivot end of said fluorescent unit respectively, and two connecting wires extended from said two resilient terminals to two ends of said illuminator through said two pivot axles respectively so as to prevent said connecting wire from being broken during a pivot movement of said fluorescent unit; and a coupling joint rotatably attached to said supporting body and pivotally connected with said fluorescent unit, so as to rotatably adjust a folding position of said fluorescent unit with respect to said supporting body, wherein said coupling joint comprises a U-shaped joint body having two parallel pivot arms for pivotally connecting a pivot end of said fluorescent unit and a joint axle integrally protruded from said joint body to rotatably mount on said second end portion of said supporting body, wherein said two pivot axles are rotatably penetrated through two inner walls of said two pivot arms of said joint body so as to pivotally connect said pivot end of said fluorescent unit to said coupling joint.

18. A fluorescent lamp and spotlight apparatus, comprising:

a supporting body having an interior chamber, a spotlight unit cavity provided at one end thereof, and an exterior mounting slot provided on a longitudinal side thereof;

a power circuit device received in said interior chamber of said supporting body;

a spotlight unit, which is disposed in said spotlight unit cavity of said supporting body and electrically connected with said power circuit device, comprising a light housing having a bulb socket adapted to replaceably mount a light bulb thereon;

a fluorescent unit comprising a shell received in said mounting slot of said supporting body, an illuminator protected by said shell, an electric connector for electrically connecting said illuminator with said power circuit device, and two pivot axles outwardly protruded from two sides of said pivot end of said fluorescent unit respectively; and a coupling joint rotatably attached to said supporting body and pivotally connected with said fluorescent unit, so as to rotatably adjust a folding position of said fluorescent unit with respect to said supporting body, wherein said coupling joint comprises a U-shaped joint body having two parallel pivot arms for pivotally connecting a pivot end of said fluorescent unit and a joint axle integrally protruded from said joint body to rotatably mount on anther end of said supporting body, wherein said two pivot axles are rotatably penetrated through two inner walls of said two pivot arms of said joint body so as to pivotally connect said pivot end of said fluorescent unit to said coupling joint, wherein said coupling joint further comprises a ring shaped holding guider having an elastic ability, and securely disposed in said second end portion of said supporting body wherein said joint axle is rotatably inserted into said holding guider, at least an engaging tooth being protruded from an inner circumferential surface of said holding guider to selectively engage with a plurality of gear teeth evenly formed on an outer circumferential surface of said joint axle, so as to hold a rotating position of said fluorescent unit with respect to said supporting body.

19. A fluorescent lamp and spotlight apparatus, as recited in claim 18, wherein said coupling joint further comprises two more said holding guiders securely received in said two pivot arms of said fluorescent unit wherein said engaging tooth of each said holding guider in said pivot arm is selectively engaging a plurality of holding tooth evenly protruded from an outer circumferential surface of said respective pivot axle so as to hold a pivotal position of said fluorescent unit with respect to said supporting body.

20. A fluorescent lamp and spotlight apparatus, comprising:

a supporting body having an interior chamber, a spotlight unit cavity provided at one end thereof, and an exterior mounting slot provided on a longitudinal side thereof, wherein said supporting body has an enlarged first end portion and an elongated second end portion, wherein said spotlight unit cavity is formed at said first end portion of said supporting body and said mounting slot is extended from said second portion towards said first end portion of said supporting body;

a power circuit device received in said interior chamber of said supporting body;

a spotlight unit, which is disposed in said spotlight unit cavity of said supporting body and electrically connected with said power circuit device, comprising a light housing having a bulb socket adapted to replaceably mount a light bulb thereon;

a fluorescent unit comprising a shell received in said mounting slot of said supporting body, an illuminator protected by said shell, and an electric connector for electrically connecting said illuminator with said power circuit device; and a coupling joint rotatably attached to said supporting body and pivotally connected with said fluorescent unit, so as to rotatably adjust a folding position of said fluorescent unit with respect to said supporting body, wherein said coupling joint comprises a U-shaped joint body having two parallel pivot arms for pivotally connecting a pivot end of said fluorescent unit and a joint axle integrally protruded from said joint body to rotatably mount on said second end portion of said supporting body, wherein said coupling joint further comprises a ring shaped holding guider having an elastic ability, and securely disposed in said second end portion of said supporting body wherein said joint axle is rotatably inserted into said holding guider, at least an engaging tooth being protruded from an inner circumferential surface of said holding guider to selectively engage with a plurality of gear teeth evenly formed on an outer circumferential surface of said joint axle, so as to hold a rotating position of said fluorescent unit with respect to said supporting body.

21. A fluorescent lamp and spotlight apparatus, comprising:

a supporting body having an interior chamber, a spotlight unit cavity provided at one end thereof, and an exterior mounting slot provided on a longitudinal side thereof, wherein said supporting body has an enlarged first end portion and an elongated second end portion, wherein said spotlight unit cavity is formed at said first end portion of said supporting body and said mounting slot is extended from said second portion towards said first end portion of said supporting body;

a power circuit device received in said interior chamber of said supporting body;

a spotlight unit, which is disposed in said spotlight unit cavity of said supporting body and electrically connected with said power circuit device, comprising a light housing having a bulb socket adapted to replaceably mount a light bulb thereon;

a fluorescent unit comprising a shell received in said mounting slot of said supporting body, an illuminator protected by said shell, an electric connector for electrically connecting said illuminator with said power circuit device, and two pivot axles outwardly protruded from two sides of said pivot end of said fluorescent unit respectively; and a coupling joint rotatably attached to said supporting body and pivotally connected with said fluorescent unit, so as to rotatably adjust a folding position of said fluorescent unit with respect to said supporting body, wherein said coupling joint comprises a U-shaped joint body having two parallel pivot arms for pivotally connecting a pivot end of said fluorescent unit and a joint axle integrally protruded from said joint body to rotatably mount on said second end portion of said supporting body, wherein said two pivot axles of said fluorescent unit are rotatably penetrated through two inner walls of said two pivot arms of said joint body so as to pivotally connect said pivot end of said fluorescent unit to said coupling joint, wherein said coupling joint further comprises a ring shaped holding guider having an elastic ability, and securely disposed in said second end portion of said supporting body wherein said joint axle is rotatably inserted into said holding guider, at least an engaging tooth being protruded from an inner circumferential surface of said holding guider to selectively engage with a plurality of gear teeth evenly formed on an outer circumferential surface of said joint axle, so as to hold a rotating position of said fluorescent unit with respect to said supporting body.

* * * * *